US006518443B1

(12) United States Patent
Beyer et al.

(10) Patent No.: US 6,518,443 B1
(45) Date of Patent: Feb. 11, 2003

(54) METHOD FOR TREATING OIL SEED FLAKES PRIOR TO OIL EXTRACTION

(75) Inventors: Wolfgang Beyer, Hermannsburg (DE); Rüdiger Heilmann, Kleinostheim (DE)

(73) Assignee: MG Technologies AG, Frankfurt am Main (DE)

( * ) Notice: Subject to any disclaimer, the term of this patent is extended or adjusted under 35 U.S.C. 154(b) by 0 days.

(21) Appl. No.: 09/868,431

(22) PCT Filed: Nov. 2, 1999

(86) PCT No.: PCT/EP99/08364

§ 371 (c)(1),
(2), (4) Date: Jul. 20, 2001

(87) PCT Pub. No.: WO00/36058

PCT Pub. Date: Jun. 22, 2000

(30) Foreign Application Priority Data

Dec. 16, 1998 (DE) ..... 198 58 015

(51) Int. Cl.[7] ..... C11B 1/02; C11B 1/04; C11B 3/04

(52) U.S. Cl. ..... 554/201; 554/202; 554/175

(58) Field of Search ..... 554/201, 202

(56) References Cited

FOREIGN PATENT DOCUMENTS

EP 0 148 143 7/1985

EP 0 534 573 3/1993

OTHER PUBLICATIONS

"Feucht–Warmebehandlung Von Rapsaat..." by W. Beyer, Fett–Lipid vol. 99, 2, 1997.

"Nahrungsfette und –ole" by M. Bockisch, 1993, Ulmer Verlag, Stuttgart.

Y.H. Hui "Bailey's Industrial Oil and Fat Products" vol. 2: Edible Oil and Fat Products, 1996.

*Primary Examiner*—Deborah D. Carr
(74) *Attorney, Agent, or Firm*—Herbert Dubno

(57) ABSTRACT

The oil seed is first of all comminuted and then formed into flakes by means of rolling, before it is supplied to the recovery of oil. The flakes are charged into a transporting mixer, to which steam and/or water are supplied at the same time, and the flakes in the mixer are transported to the outlet of the mixer with a dwell time of 5 to 50 seconds. With a moisture content of 8 to 20 wt-% and with temperatures in the range from 90 to 110° C., the flakes are withdrawn from the mixer and passed through an annealing zone, in which the flakes are moved over heated trays with dwell times of 15 to 50 minutes and temperatures in the range from 90 to 110° C. The flakes are withdrawn from the annealing zone with a residual moisture which still amounts to at least half the moisture content at the inlet of the annealing zone, and are passed through a drying and cooling zone in which the flakes are converted to granules which are supplied to the recovery of oil.

3 Claims, 1 Drawing Sheet

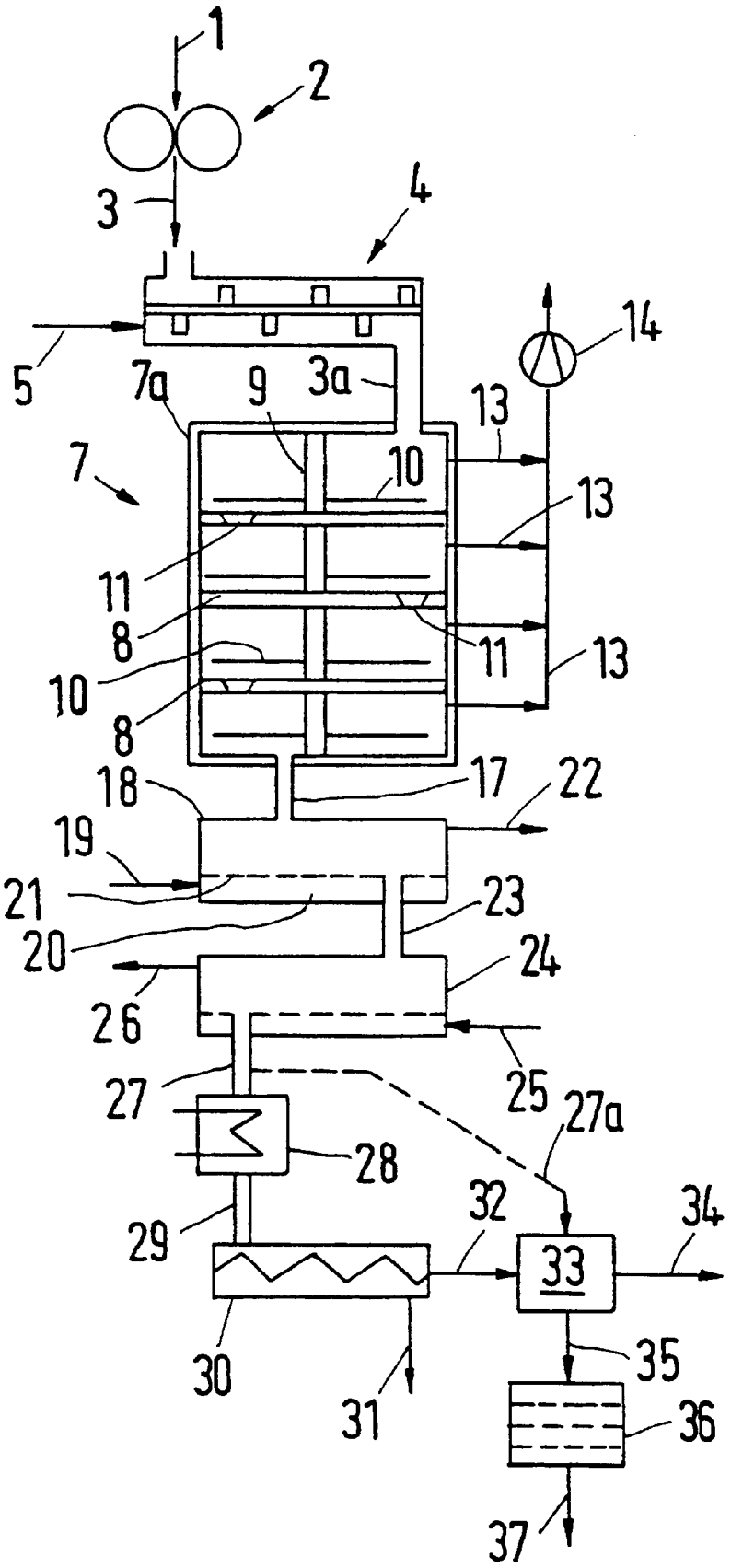
1
2
3
4
5
7a
9
3a
14
13
7
10
13
11
8
11
13
10
8
18
17
22
19
21
23
20
24
26
25
27
27a
28
32
34
29
33
30
35
31
36
37

METHOD FOR TREATING OIL SEED FLAKES PRIOR TO OIL EXTRACTION

This application is a 371 of PCT/EP99/08364 filed Nov. 2, 1999.

This invention relates to a process of treating oil seed flakes prior to the recovery of oil, wherein the oil seed is comminuted and by means of rolling is formed into flakes having a thickness of about 0.1 to 0.5 mm, before they are supplied to the recovery of oil.

Processes of this type are known and described for instance in DE-A-24 07 453. There is performed a moisture-heat treatment of the oil seeds in a multi-stage shaking trough. When refining the oils recovered there is the difficulty that degumming only by means of a water treatment leaves too much phosphatides in the oil, so that this oil cannot be refined physically with an economically acceptable effort.

It is the object underlying the invention to deactivate disturbing amounts of enzymes in the oil seed, in order to eliminate the formation of non-hydratable phosphatides during the recovery of oil in the oil press and/or extraction, which phosphatides would otherwise get into the oil recovered and render degumming and refining more difficult. In accordance with the invention this is achieved in that the flakes are charged into a transporting mixer with a temperature of 20 to 50° C., to which mixer steam and/or water are supplied at the same time, that the flakes in the mixer are transported to the outlet of the mixer with a dwell time of 5 to 50 seconds, and at the outlet flakes are withdrawn from the mixer with temperatures in the range from 90 to 110° C. and a moisture content of 8 to 20 wt-%, that the flakes from the mixer are passed through an annealing zone in which the flakes are moved over heated trays with dwell times of 15 to 50 minutes and temperatures in the range from 90 to 110° C., that the flakes are withdrawn from the annealing zone with a residual moisture which still amounts to at least half the moisture content at the inlet of the annealing zone, and that the flakes are passed through a drying zone with temperatures of 90 to 120° C. and a cooling zone, until oil seed granules are formed, before the granules are charged into a press and/or extraction for the recovery of oil.

The process is chiefly suited for rape seed, but also for sunflower seed, soybeans and linseed. Due to the heat treatment with simultaneous presence of moisture in the transporting mixer and in the annealing zone the deactivation of enzymes is achieved, which would render the refining of oil more difficult. These enzymes include in particular phospholipase and lipoxygenase and in the case of rape seed especially also myrosinase. By means of the deactivation, the increase of non-hydratable phosphatides in the crude oil during the recovery in the oil press and also in a solvent extraction is wholly or largely prevented. As a result, the phosphatide content in the crude oil recovered can be reduced by means of a simple water treatment for degumming such that the oil degummed can directly be supplied to the physical refining. In degumming by means of water, the hydratable phosphatides (lecithin) are separated. Non-hydratable phosphatides (NHP) are, however, left in the crude oil which is supplied to refining. The relatively simple physical refining (bleaching and deodorizing) is sufficient in the present case, as water degumming of the crude oil recovered from rape seed, sunflower seed or soybeans already lowers the phosphatide content sufficiently.

In the recovery of oil from rape seed, an important product not only is the oil, but also the rape grit which is used as feedstuff. When the activity of myrosinase in the rape flakes is too high, the further treatment of the solids (expellers) from the oil press also leads to a rape grit which contains disturbing amounts of decomposition products, which are caused by the activity of myrosinase. By deactivating the disturbing enzymes already before the oil press it is now advantageously achieved that the disturbing enzymes and also the myrosinase are biochemically inactivated, which facilitates degumming and keeps away disturbing amounts of decomposition products from the rape grit.

Advantageously, the oil seed flakes are charged into the transporting mixer with a moisture content of 3 to 12 wt-%, to which mixer additional moisture is supplied. Expediently, the flakes are heated in the transporting mixer to a temperature of 80° C. within 3 to 10 seconds. It was noted that up to a temperature in the range from about 70 to 75° C. enzymatic reactions take place in the flakes to an increased extent, which reactions lead to undesired substances. By means of a rapid heating in the transporting mixer the formation of these disturbing substances can be prevented or be maintained at a low level.

The process is particularly suited for processing rape seed, because in addition to the above-mentioned lipases, there can also largely be deactivated the enzyme myrosinase, which is typical for rape seed. During the recovery of oil from rape species with a higher or high content of thioglucosides (GLS), non-deactivated myrosinase leads to undesired decomposition processes (hydrolysis) of GLS, where volatile isothiocyanates (ITC) and non-volatile oxazolidine thiones (VOT) are obtained as reaction products, which can impair the oil cake, the rape grit and the oil quality. Due to the product structure of the rape granules there is furthermore provided the possibility to perform a direct extraction of the rape flakes with economically acceptable means without use of an oil press.

Embodiments of the process are illustrated by means of the drawing; it shows a flow diagram of the process, where rape seed is treated. The treatment of sunflower seed, soybeans or linseed can be effected analogously.

The rape seed comes from a not represented pre-cleaning and with grain sizes of about 1 to 3 mm is supplied through line 1 to the flocculating rollers 2, which form rape seed flakes with thicknesses of about 0.1 to 0.5 mm and preferably not more than 0.3 mm. Preferably with temperatures of about 20 to 50° C., the flakes are supplied through line 3 to a transporting mixer 4, which may for instance be a paddle mixer or a screw mixer. In the vicinity of the mixer inlet, steam is supplied to the mixer through line 5, which steam condenses in the mixer 4 and moistens the rape flakes. In addition to steam, water may be sprayed into the mixer 4, in order to achieve the desired moistening. In the mixer 4, a dwell time of the rape flakes of 5 to 50 seconds and mostly 8 to 30 seconds is ensured. At the mixer outlet 3*a*, there are obtained flakes with temperatures in the range from 90 to 110° C. and a moisture content of 8 to 20 wt-% and mostly 10 to 16 wt-%.

From the mixer outlet 3*a*, the moistened flakes get into an annealing space 7, where the flakes are agitated and with dwell times of 15 to 50 minutes are maintained at temperatures in the range from 90 to 110° C. The annealing space 7 has steam-heated trays 8 and also a steam-heated heating jacket 8*a*, and it is provided with a vertical rotatable shaft 9 and stirring arms 10 disposed thereon. The stirring arms 10 move the rape flakes over the heated trays, which have openings 11, through which the flakes fall down onto the tray disposed thereunder. Through discharge lines 13 and a blower 14 steam is sucked off from the annealing space 7.

After a dwell time of 15 to 50 minutes, the rape flakes fall through the passage 17 into the drying chamber 18, to which through line 19 hot air of 90 to 120° C. is supplied, which first of all flows into a distribution chamber 20 and through a perforated tray 21 is then passed upwards through the rape flakes. The waste air is discharged through line 22. The dried flakes, which by shrinkage have been formed into granules, are delivered through a passage 23 into a cooling chamber 24, to which cold air of about 20° C. is supplied through line 25 and is passed distributed through the granules. Cold waste air escapes via line 26. The dried and cooled granules leave the cooling chamber 24 through the passage 27 with temperatures in the range from 40 to 70° C. and a moisture content which lies in the range from about 4 to 10 wt-%.

Before the granules are supplied to the oil press 30, they are first of all brought to temperatures of 105 to 120° C. through indirect heating by means of steam in the heat exchanger 28, and are then charged to the oil press through line 29. Crude oil is withdrawn from the press 30 through line 31 and is supplied to the not represented water degumming and refining, as is known per se. If the oil press is a prepress, the rape expellers produced are supplied through a line 32 to a solvent extraction 33 known per se, where by means of apolar solvents (hexane) the residual oil is largely removed from the rape expellers (rape grit). Oil-containing solvent (miscella) leaves the extraction 33 through line 34 and flows into the miscella distillation, where the solvent is separated from the crude oil.

Through line 35, the extracted rape expellers are delivered to a debenziner known per se, also referred to as toaster 36, through a line 35, in order to remove the solvent (hexane) contained in the rape grit. The finished grit is withdrawn via line 37 and supplied to a not represented grit cooling plant. One process variant consists in that the granules by-pass the oil press 30 via line 27*a* indicated in broken lines and are supplied directly to the extraction 33.

EXAMPLE

Purified rape seed with an oil content of 40 wt-% and a $H_2O$ content of 6 wt-% is comminuted and further processed with a temperature of about 40° C. in a process as represented in the drawing. From the flocculating rollers 2 rape flakes are coming with a thickness of 0.1 to 0.3 mm and a temperature of 43° C., which flakes are charged into a paddle mixer 4. At the same time, steam of 5 bar and 150° C. is supplied to the mixer, and the flakes are heated to 80° C. within 6 to 7 seconds.

After a dwell time of 20 seconds in the mixer, the flakes reach the annealing space 7 with a temperature of 103° C. and a moisture content of 13 wt-%. In the annealing space, the dwell time is 30 minutes, and the flakes are withdrawn through the passage 17 with a temperature of 100° C. In the drying chamber 18, the temperatures reach 115° C., where the flakes are shrinking to form granules. From the adjoining cooling chamber 24, granules are withdrawn with a temperature of 60° C. The granules in the passage 27 have a moisture of 5 wt-%, in heating pans they are brought to a temperature of 105° C., before they enter the oil press 30.

The crude oil recovered is supplied to a water degumming via line 31; from 100 t purified rape seed the oil press 30 supplies 27.2 t crude oil, further 12.2 t crude oil are recovered from the cooled expeller by means of extraction. The deoiled rape grit, which is recovered upon extraction, debenzining and drying, is obtained in an amount of 62 t. The oil degummed by means of 0.5 t water only contains 0.04 wt-% phosphatides. Degumming by means of water provides 1 t lecithin sludge, from which 0.5 t dried crude lecithin can be recovered.

What is claimed is:

1. A process of treating oil seed flakes prior to the recovery of oil, wherein the oil seed is comminuted and by means of rolling is formed into flakes having a thickness of about 0.1 to 0.5 mm, before they are supplied to the recovery of oil, characterized in that the flakes are charged into a transporting mixer with a temperature of 20 to 50° C., to which mixer steam and/or water are supplied at the same time, that the flakes in the mixer are transported to the outlet of the mixer with a dwell time of 5 to 50 seconds, and at the outlet flakes are withdrawn from the mixer with temperatures in the range from 90 to 110° C. and a moisture content of 8 to 20 wt-%, that the flakes from the mixer are passed through an annealing zone in which the flakes are moved over heated trays with dwell times of 15 to 50 minutes and temperatures in the range from 90 to 110° C., that the flakes are withdrawn from the annealing zone with a residual moisture which still amounts to at least half the moisture content at the inlet of the annealing zone, and that the flakes are passed through a drying zone with temperatures of 90 to 120° C. and a cooling zone, until oil seed granules are formed, before the granules are delivered to the recovery of oil.

2. The process as claimed in claim 1, characterized in that the flakes are heated in the transporting mixer to a temperature of 80° C. within 3 to 10 seconds.

3. The process as claimed in claim 1, characterized in that the oil seed flakes are charged into the transporting mixer with a moisture content of 3 to 12 wt-%.

* * * * *